US006769929B2

(12) United States Patent
Saka et al.

(10) Patent No.: US 6,769,929 B2
(45) Date of Patent: Aug. 3, 2004

(54) CONNECTOR AND A CONNECTOR ASSEMBLY

(75) Inventors: Yukinori Saka, Yokkaichi (JP); Atsushi Yamaoka, Yokkaichi (JP); Koji Okutani, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/403,388

(22) Filed: Mar. 28, 2003

(65) Prior Publication Data

US 2003/0186579 A1 Oct. 2, 2003

(30) Foreign Application Priority Data

Mar. 28, 2002 (JP) ..... 2002-092746
May 27, 2002 (JP) ..... 2002-152738

(51) Int. Cl.[7] ..... H01R 13/627
(52) U.S. Cl. ..... 439/352; 439/489
(58) Field of Search ..... 439/352, 489, 439/358, 357

(56) References Cited

U.S. PATENT DOCUMENTS 6,241,542 B1 6/2001 Nishide et al.
6,341,974 B1 * 1/2002 Konoya ..... 439/352
6,368,140 B2 * 4/2002 Torii ..... 439/352
6,386,898 B1 * 5/2002 Taguchi ..... 439/352

* cited by examiner

*Primary Examiner*—Gary F Pauman
(74) *Attorney, Agent, or Firm*—Anthony J. Casella; Gerald E. Hespos

(57) ABSTRACT

A reconfigurable interactive kiosk for producing a printout of a digital image. The interactive kiosk includes: a processor for processing digital images. The processor includes memory, display screen, user input device, updatable stored scalable digital images and a hard copy medium connected to the processor for transferring the combined digital image to a hard copy medium that can be a composite image on a single size/type of medium, or on multiple size/types of medium. A camera captures a digital image and provides the captured image to the processor. At least one of a CD ROM drive, a floppy disk drive and a photo scanner may be connected for adding digital images to the user input. Input devices may include a roller ball, keypad, microphone and joystick and/or laser gun and display screen icons for selecting a desired function represented by the selected icon. The processor displays a menu of operational instructions for a user on the display screen that may be a touch screen, which may include animation to aid the user. The kiosk further includes a web interface providing the owner/operator access in order to facilitate upgrades, maintenance, and for ascertaining operations reports for marketing purposes.

17 Claims, 21 Drawing Sheets

FIG. 11(A

CONNECTOR AND A CONNECTOR ASSEMBLY

BACKGROUND OF THE INVENTION

1. Field of the Invention

The invention relates to a connector and to a connector assembly provided with a partial connection preventing function.

2. Description of the Related Art

U.S. Pat. No. 6,241,542 and FIGS. 21 and 22 herein show a connector used in an airbag circuit of an automotive vehicle and constructed to prevent the connector from being left partly connected during a connecting operation. With reference to FIGS. 21 and 22, the connector has male and female housings 1 and 2 that are connectable with one another. The male housing 1 has a lock arm 3 that is deformed resiliently by a lock 4 of the female housing 2 as the male and female housings 1, 2 are being connected. A slider 5 is assembled with the male housing 1 and is biased forwardly by a spring 6. The deformed lock arm 3 prevents a backward movement of the slider 5. A rib 7 of the female housing 2 compresses the spring 6 during connection and a biasing force for separating the housings 1, 2 is accumulated in the spring 6. The biasing force in the spring 6 is released if the connecting operation is interrupted with the two connectors 1, 2 only partly connected to separate the housings 1, 2 forcibly. This prevents the two housings 1, 2 from being left partly connected.

The lock arm 3 returns resiliently to its original shape and engages the lock 4 when the connectors 1, 2 are connected properly. Thus, the lock arm 3 is disengaged from the slider 5, and the biasing force of the spring 6 is released to move the slider 5 back. At this time, a restricting portion 8 of the slider 5 enters a deformation space above the lock arm 3 and prevents the lock arm 3 from deforming. In this way, the two housings 1, 2 are held in a properly connected condition, and the connection reliability of the airbag circuit can be improved.

The two housings 1, 2 may have to be separated for maintenance or other reason. Separation is achieved by moving the slider 5 forward to retract the restricting portion 8 from the lock arm 3. The lock arm 3 then is deformed and disengaged from the lock 4 and the male housing 1 is pulled back.

The slider 5 must be pushed forward and the male housing 1 must be pulled back in succession to separate the two housings 1, 2. The need to operate the male housing 1 and the slider 5 in completely opposite directions creates difficulties and operational inefficiencies.

The present invention was developed in view of the above problem and an object thereof is to improve separation operability.

SUMMARY OF THE INVENTION

The invention relates to a connector with a housing formed with a resilient lock arm. The housing is connectable with a mating housing formed with a lock. The lock arm deforms and moves onto the lock of the mating housing in the process of connecting the two housings. The lock arm then resiliently returns toward an undeformed condition and engages the lock when the housings are connected properly. A slider is assembled to the housing and is movable forward and back substantially along a connecting direction of the housings between a deformation preventing position where the slider enters a deformation space for the lock arm to prevent deformation of the lock arm and a deformation permitting position where the slider is retracted from the deformation space to permit deformation of the lock arm. At least one curved biasing member is mounted between the slider and the mating housing.

The two housings can be aligned with one another for connection with the slider at the deformation permitting position. Connection begins by moving the housings toward one another along the connecting direction. As a result, the lock arm moves onto the lock and deforms. The deformed lock arm engages the slider and prevents the slider from moving forward to the deformation preventing position. Accordingly, the biasing member is compressed between the mating housing and the slider and accumulates a biasing force to separate the housings. The lock arm returns to and undeformed condition and engages the lock when the housings are connected properly. Thus, the slider is freed, and the biasing force accumulated in the biasing member is released to move the slider forward to the deformation preventing position and prevents further deformation of the lock arm. Consequently, the housings are locked firmly together.

The connecting operation could be interrupted halfway. In this situation, the biasing force accumulated in the biasing member is released to separate the two housings. This prevents the two connectors from being left partly connected.

The biasing member preferably is curved through an arc of over 120°. Thus, the slider is moved forward by the biasing force of the biasing member when the housings are connected properly. Accordingly, the slider is operated in substantially the same direction as the mating housing is separated, thereby making separation operability better.

The housings can be separated by moving the slider back from the deformation preventing position to the deformation permitting position. The lock arm then is deformed and the housing is pulled back from the mating housing.

Opposite ends of the curved biasing member preferably face forward. One end preferably is received by a receiving portion of the slider and the other end is pushed by a pushing portion of the housing. Thus, the biasing member is compressed between the pushing portion and the receiving portion.

The slider preferably comprises a holding arm for engaging a holding portion of the mating housing and preventing the slider from moving forward from the deformation permitting position. At least one of the holding arm and the holding portion has a guide for guiding the holding arm through a resilient deformation to disengage the holding arm from the holding portion when a force of a specified intensity or higher acts on the slider to move the slider forward.

The slider can be held at the deformation permitting position until the housings are connected. Thus, the connecting operation can be performed with the slider at the deformation permitting position, thereby improving connection operability. The holding arm is guided through a resilient deformation and disengages automatically from the holding portion when the biasing force of the biasing member moves the slider forward during the connecting operation. As a result the slider moves forward to the deformation preventing position. The holding arm and the holding portion have a semi-locking construction. Hence, operability is better then a case where the holding arm must be deformed separately.

The slider preferably has a pushable portion to push the lock arm and to deform the lock arm when the slider is at the deformation permitting position.

The pushable portion is operated while the slider is moved back from the deformation preventing position to the deformation permitting position for separating the housings. Thus, the lock arm can be pushed and deformed, and operability is better than a case where the lock arm needs to be pushed after the slider is moved back.

The lock arm preferably comprises a disengagement guide that is pushed by the slider as the slider is moved toward the deformation permitting position for separating the housings. The disengagement guide guides the lock arm through a deformation that disengages the lock arm from the lock. Thus, the lock arm is deformed automatically by moving the slider back, and separation operability is improved as compared to a case where an operation of resiliently deforming the lock arm must be performed separately.

The slider may have a protecting portion to substantially cover at least part of the lock arm and the holding arm to prevent the lock arm and the holding arm from being inadvertently operated.

A seal ring may be mounted on the housing to provide water tightness between the housings.

A moving stroke of the slider may be substantially the same as a maximum compression of the biasing member. Accordingly, the biasing member can be returned to the substantially same state as before the connecting operation.

These and other objects, features and advantages of the present invention will become more apparent upon reading of the following detailed description of preferred embodiments and accompanying drawings. It should be understood that even though embodiments are separately described, single features thereof may be combined to additional embodiments.

BRIEF DESCRIPTION OF THE DRAWINGS

FIGS. 11(A) and 11(B) are sections along 11(A)—11(A) and 11(B)—11(B) of FIG. 7 before the female housing is connected with a male housing.

DESCRIPTION OF THE PREFERRED EMBODIMENTS

Figure 11B:
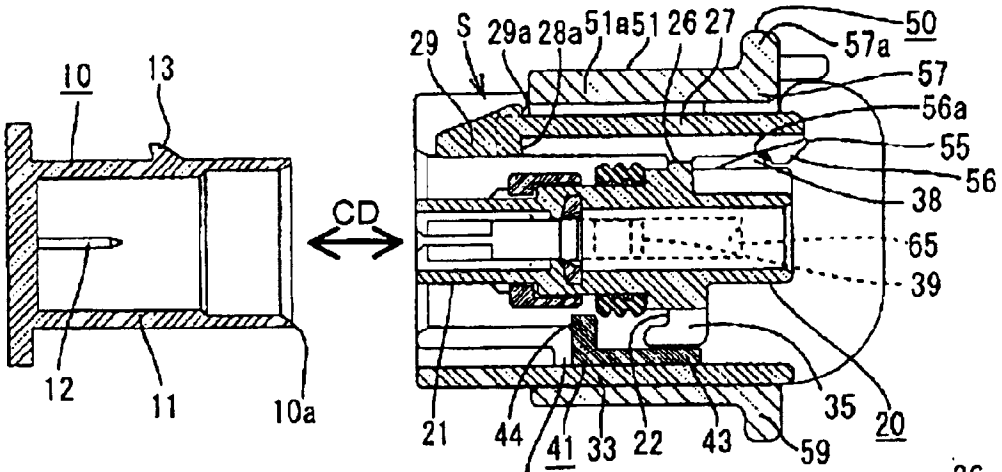

A connector according to the invention is shown in FIGS. 1 to 15 and is intended for use in an airbag circuit of an automotive vehicle. This connector includes a male housing 10 connected directly with a piece of equipment and a female housing 20 at ends of unillustrated wires. The male and female housings 10, 20 are connectable with each other. In the following description, engaging sides of the two housings 10, 20 are referred to as the front and reference is made to FIGS. 1 and 11 concerning the vertical direction.

Figure 11B:
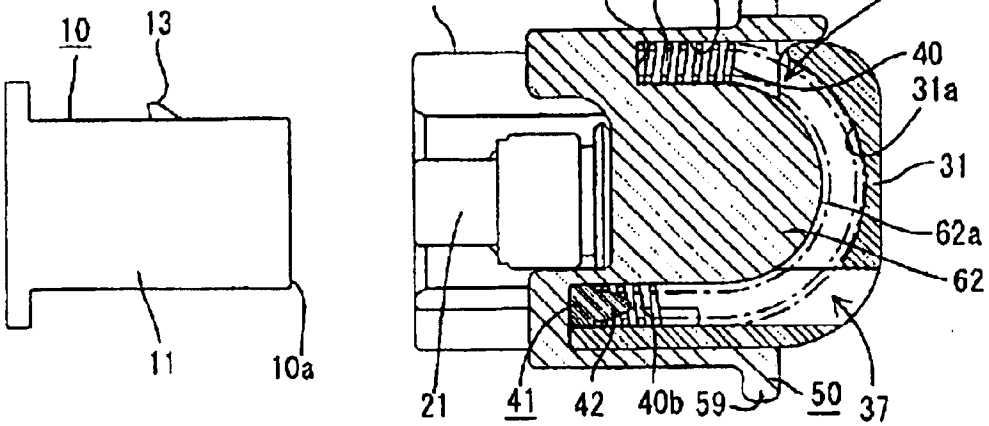

The male housing 10 is made e.g. of a synthetic resin and, as shown in FIG. 11, has a substantially tubular receptacle 11 that projects forward. Four substantially tab-shaped male terminals 12 project from the back wall of the male housing 10 and are surrounded by the receptacle 11. A lock 13 projects at a substantially widthwise center of the upper surface of the receptacle 11. The front end surface of the lock 13 slopes up and to the back.

Figure 1:
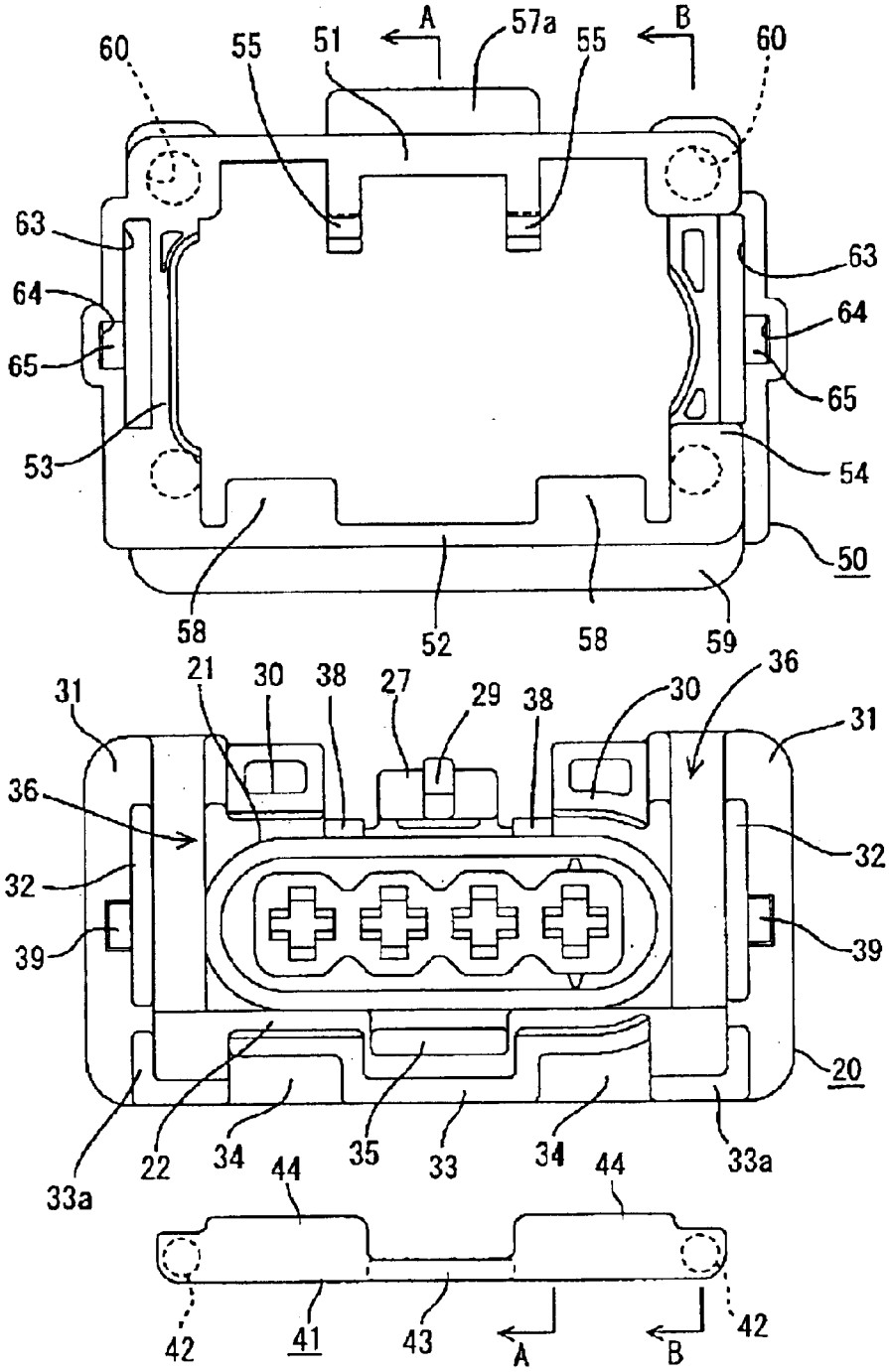
FIG. 1 is a front view of a female housing, a slider and a spring press according to one embodiment of the invention.
Figure 5:
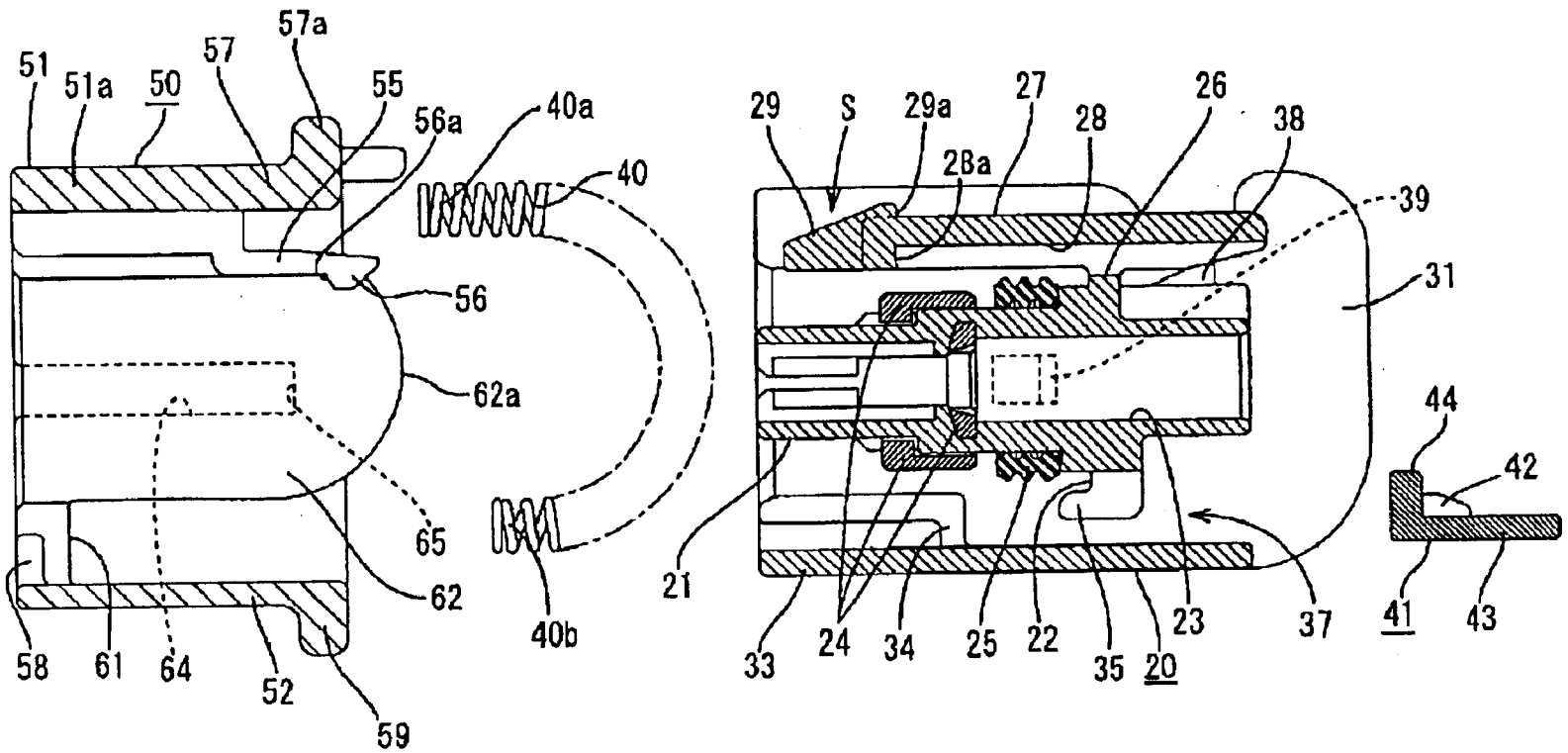
FIG. 5 is a section along 5—5 of FIG. 1.

The female housing 20 is made e.g. of a synthetic resin and, as shown in FIGS. 1 and 5, has a terminal accommodating portion 21 that accommodates female terminal fittings (not shown) connected with wires. A fitting groove 22 is formed around a front portion of the terminal accommodating portion 21, and defines a substantially oblong ring. The receptacle 11 of the male housing 10 is fittable from the front into the fitting groove 22.

Figure 4:
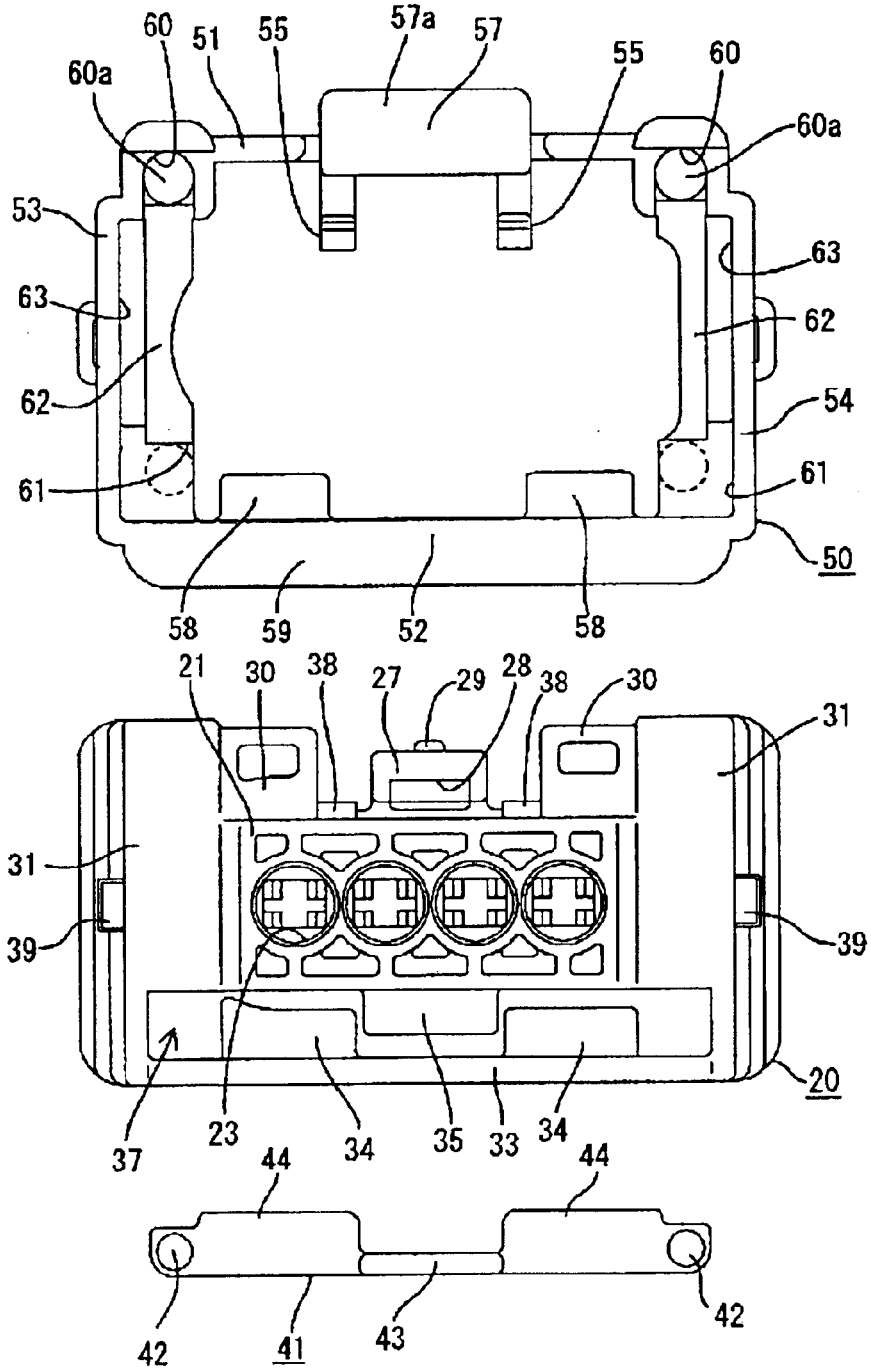
FIG. 4 is a rear view of the female housing, slider and spring press.

Four cavities 23 are formed substantially side-by-side in the terminal accommodating portion 21, as shown in FIGS. 4 and 5, and female terminal fittings are insertable from behind into the cavities 23. A retainer 24 is mounted sideways into the terminal accommodating portion 21 and enters the respective cavities 23 for engaging and locking the female terminal fittings. A seal ring 25 is fit on the outer peripheral surface of the terminal accommodating portion 21 and is squeezed between the outer peripheral surface of the terminal accommodating portion 21 and the inner peripheral surface of the receptacle 11 to provide a watertight fit between the two housings 10, 20. The retainer 24 is provided before the seal ring 25 to prevent the seal ring 24 from coming out.

A support 26 projects substantially at a widthwise center of the upper surface of the terminal accommodating portion 21, as shown in FIGS. 11 and 5, and a lock arm 27 extends forward and back from the support 26. The lock arm 27 is resiliently deformable like a seesaw about the support 26. A portion of the lock arm 27 before the support 26 is displaced out and a portion thereof after the support 26 is displaced in during resilient deformation of the lock arm 27 (see FIG. 12(A)). A deformation space S is defined above the front of the lock arm 27, and a similar deformation space is defined below the rear of the lock arm 27. A backwardly open groove 28 is formed in the lower surface of the lock arm 27. The groove 28 has a downwardly and backwardly sloped front end surface 28*a* that is engageable with the lock 13. A projection 29 projects forward and up substantially at a widthwise center of the front end of the lock arm 27. The projection 29 can move onto the lock 13 prior to other parts of the lock arm 27 in the process of connecting the two housings 10, 20. A forward-movement preventing surface 29*a* is formed at the rear end of the projection 29 (see FIG. 12(A)). Two upper walls 30 are provided at opposite sides of the outer surface of the terminal accommodating portion 21 and are spaced from the lock arm 27 by a specified distance.

Figure 2:
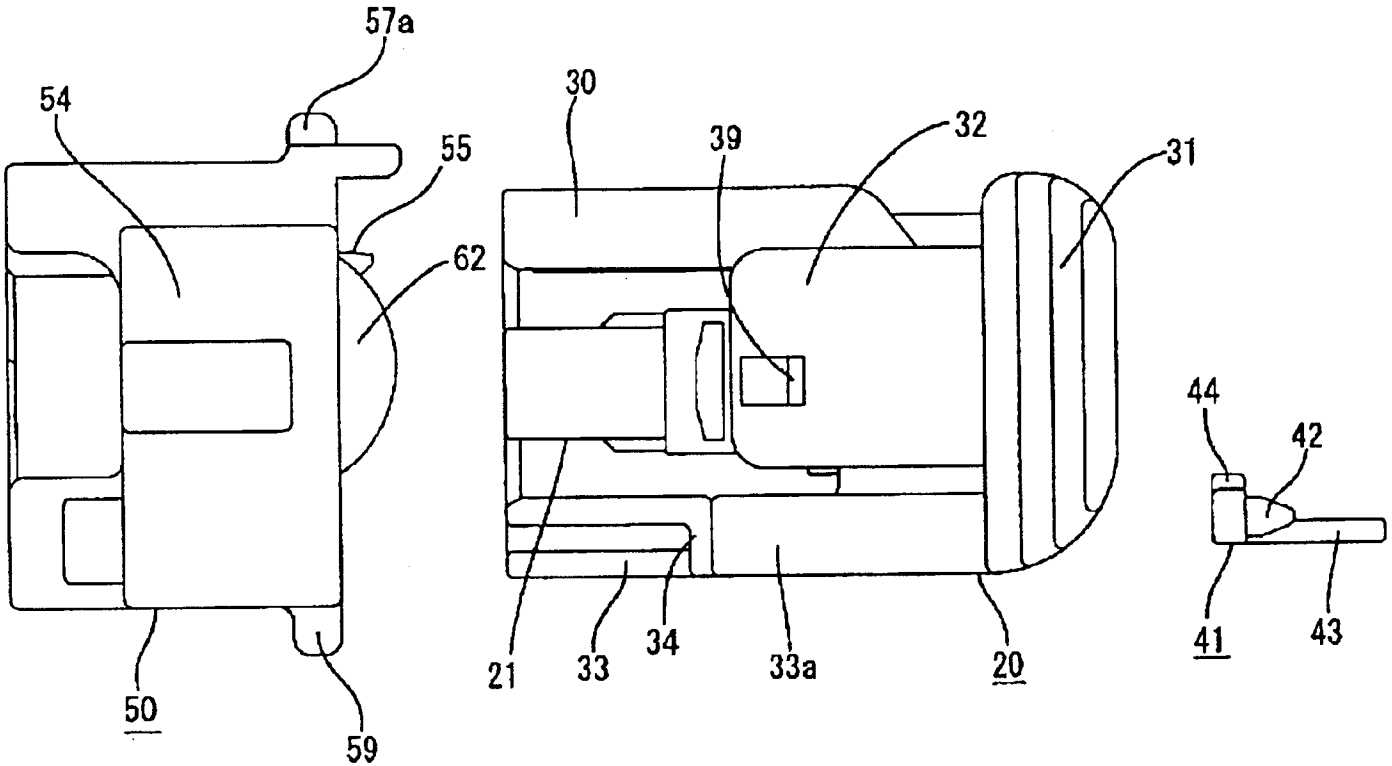
FIG. 2 is a side view of the female housing, slider and spring press.
Figure 3:
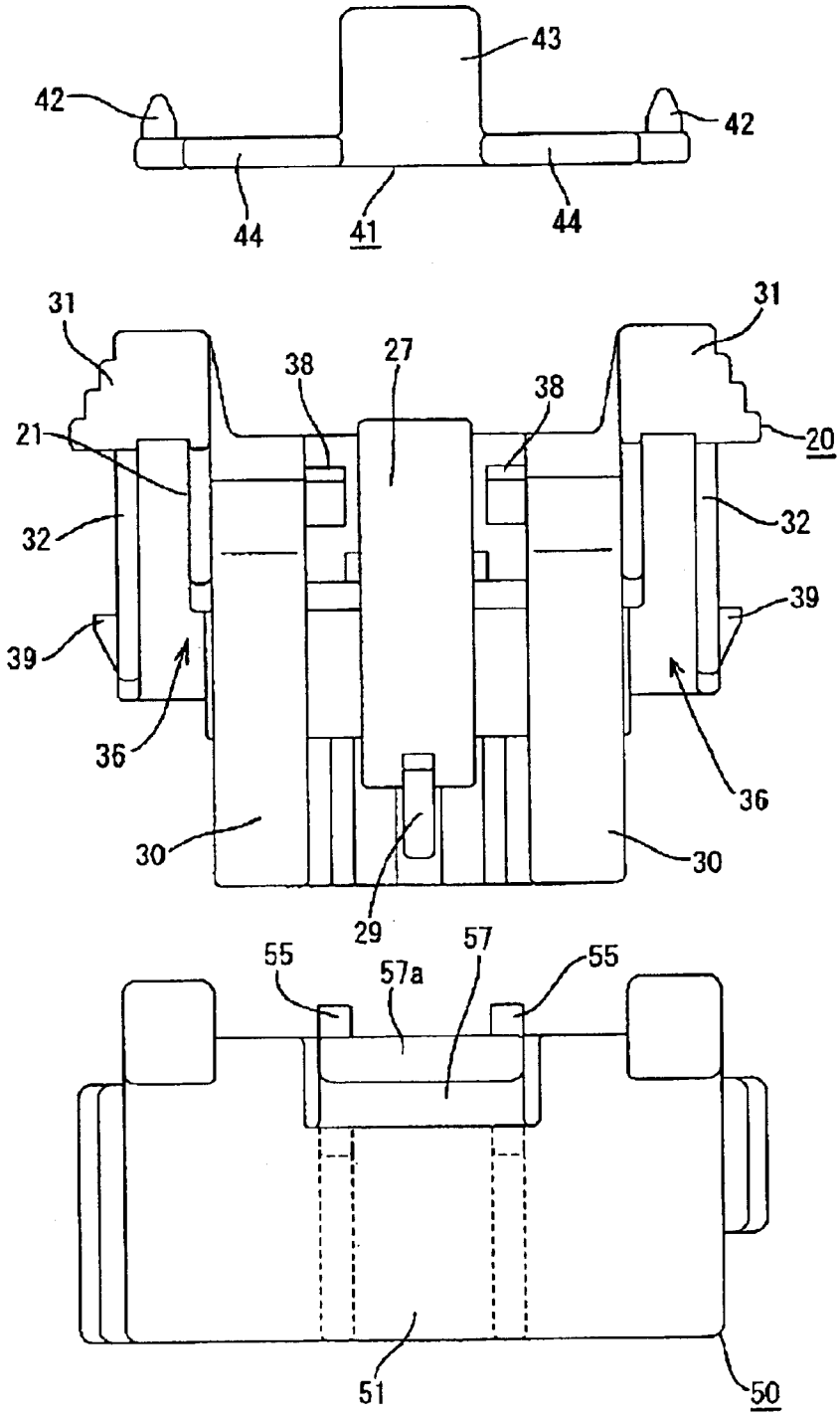
FIG. 3 is a plan view of the female housing, slider and spring press.

Vertically extending straight surfaces are formed at opposite sides of the terminal-accommodating portion 21 behind the fitting groove 22. Two push-operable portions 31 project laterally from the rear end of the opposite side surfaces of the terminal accommodating portion 21, as shown in FIGS. 2 and 3, and are used to connect the two connectors 10, 20. The outer side surfaces of the push-operable portions 31 are stepped so that the push-operable portions 31 can be pushed easily from behind. Sidewalls 32 project forward from the push-operable portions 31 and are spaced a specified distance to the terminal-accommodating portion 21. The sidewalls 32 are about half as long as the terminal-accommodating portion 21.

A bottom wall 33 bridges the bottom ends of the two push-operable portions 31 and has opposite side edges that extend along the sidewalls 32, as shown in FIGS. 1 and 2. Opposite sides 33*a* of the bottom wall 33 have front surfaces that substantially align with the front surfaces of the sidewalls 32. Additionally, a part of the bottom wall 33 corresponding to the terminal accommodating portion 21 has front surface substantially aligned with the front of the terminal-accommodating portion 21. Stopper walls 34 bulge in at opposite sides of the part of the bottom wall 33 that corresponds to the terminal-accommodating portion 21, and the fitting groove 22 is immediately inside the stopper walls 34. An engaging portion 35 projects at a substantially widthwise center of the bottom surface of the terminal-accommodating portion 21 and forms a part of the fitting groove 22 for engaging the front end of the receptacle 11.

Figure 6:
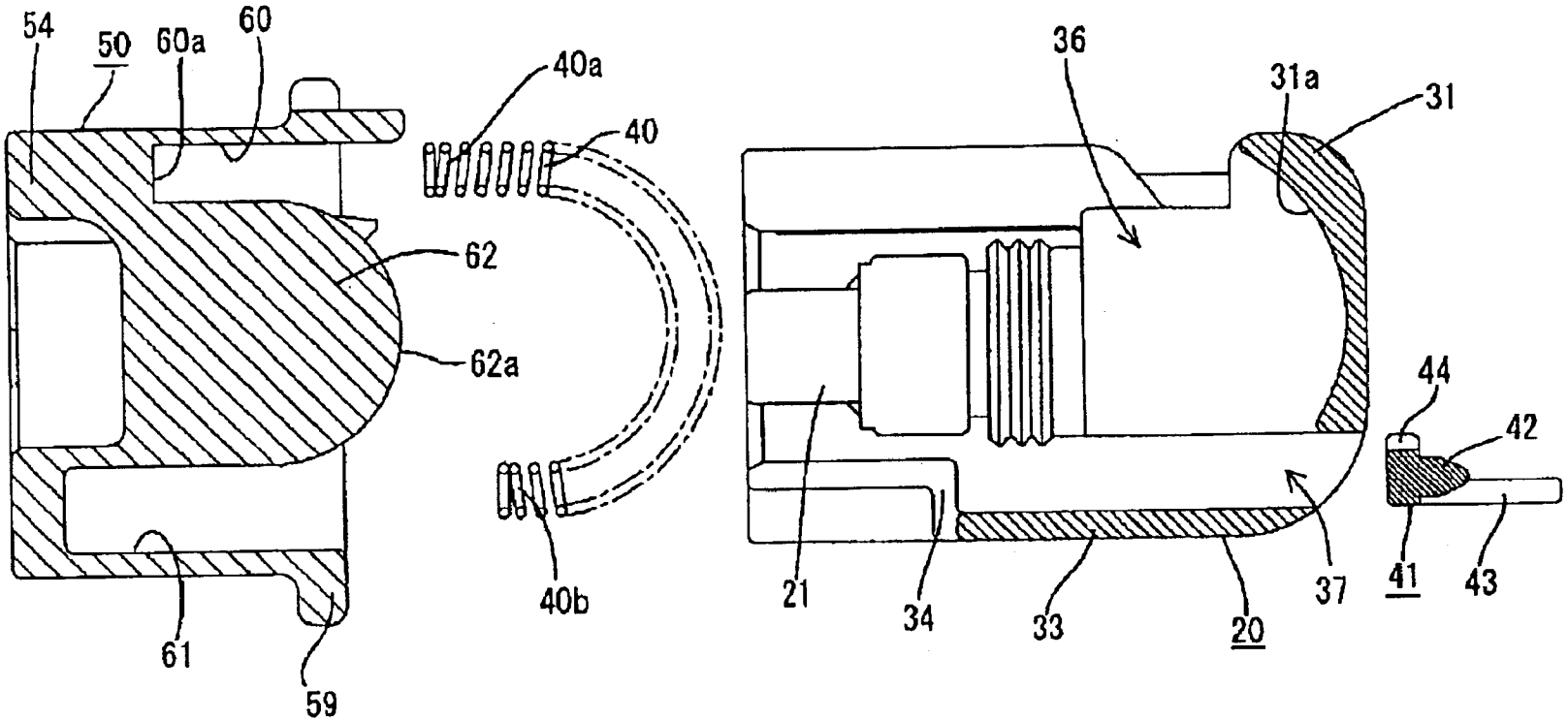
FIG. 6 is a section along 6—6 of FIG. 1.

Spring accommodating spaces 36 are formed at opposite sides of the female housing 20 and are surrounded by parts of the sidewalls 32, the terminal-accommodating portion 21, the push-operable portions 31 and the side ends 33*a* of the bottom wall 33. The spring accommodating portions 36 accommodate compression coil springs 40 from the front, as shown in FIGS. 3 and 6, so that the compression coil springs 40 are curved into a substantially U-shape that extends through an arc greater than 120°. Thus, opposite ends of the compression coil springs 40 face substantially forward. Each compression coil spring 40 has upper and lower ends 40*a* and 40*b*. A spring press 41 holds the lower end 40*b*. Middle portions of the springs 40 extend along curved surfaces 31*a* of the spring accommodating spaces 36 formed at the front of the push-operable portions 31.

Figure 7:
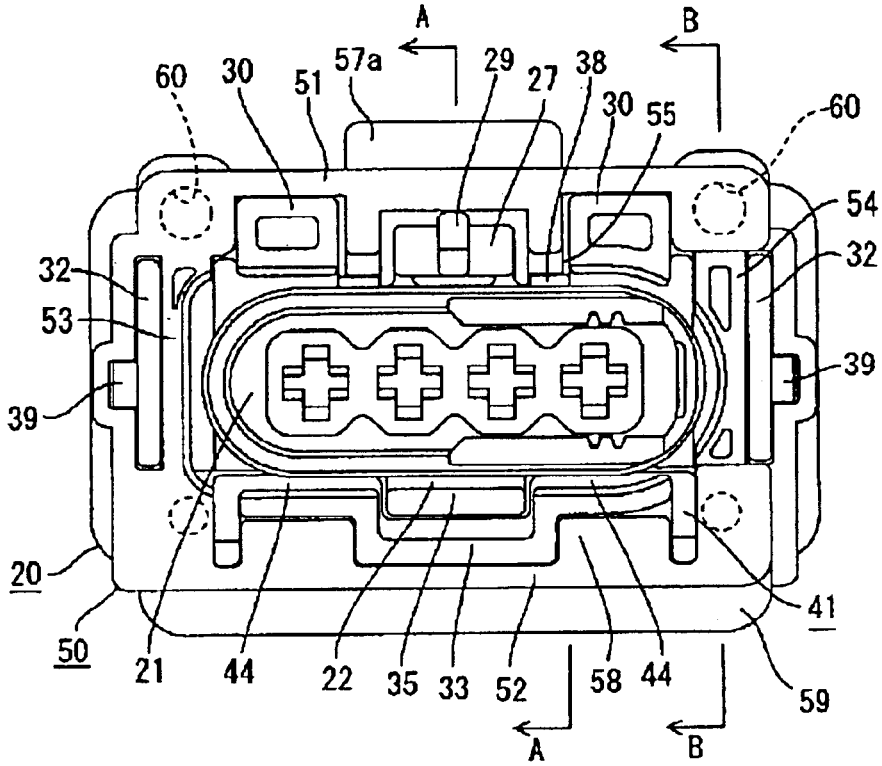
FIG. 7 is a front view with the slider assembled into the female housing.
Figure 8:
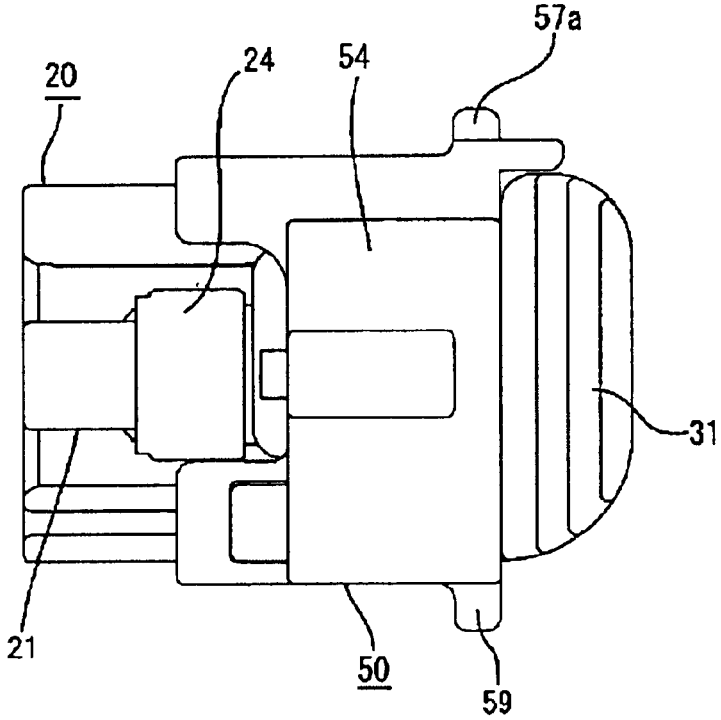
FIG. 8 is a side view with the slider assembled into the female housing.
Figure 9:
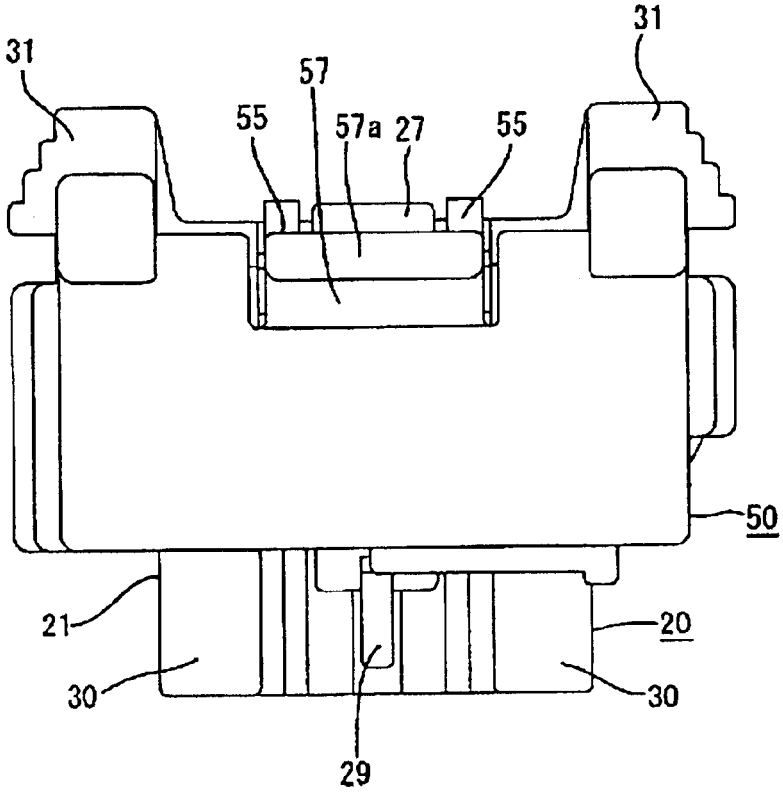
FIG. 9 is a plan view with the slider assembled into the female housing.
Figure 10:
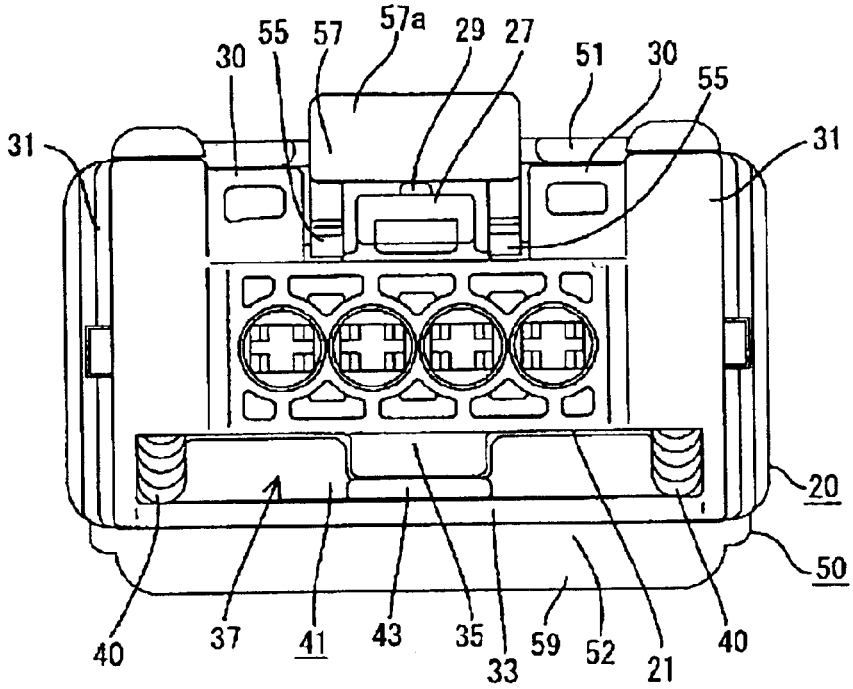
FIG. 10 is a rear view with the slider assembled into the female housing.

A substantially rectangular spring press accommodating space 37 opens rearwardly in the female housing 20 and is surrounded by the bottom wall 33, the terminal accommodating portion 21 and the push-operable portions 31, as shown in FIG. 4. A wide spring press 41 is insertable into the spring press accommodating space 37 from behind. Two tapered spring holders 42 project from the rear surface at opposite sides of the spring press 41 and fit into the lower ends 40*b* of the compression coil springs 40. A short guide 43 extends back from a substantially widthwise middle portion of the spring press 41. The guide 43 slides in contact with the upper surface of the bottom wall 33 and the lower surface of the engaging portion 35 to guide movements of the spring press 41 with respect to the female housing 20. Pushable sections 44 extend up at opposite sides of the guide 43 and enter the fitting groove 22 in the female housing 20, as shown in FIGS. 7 and 11(A). The pushable sections 44 are pushed by a front end surface 10*a* of the receptacle 11 of the male housing 10 during connection of the housings 10, 20. The spring press 41 is movable forward and back substantially along a connecting direction CD of the housings 10, 20 between an initial position (see FIG. 11) where the front surface contacts the stopper walls 34 and a pushed position (see FIG. 13) located back from the initial position.

The connector also includes a substantially rectangular frame-shaped slider 50 with a top section 51, a bottom section 52 and opposite side sections 53 and 54, as shown in FIGS. 1 and 5. The slider 50 is assembled over the female housing 20 to substantially surround the fitting groove 22. Thus, the top section 51 of the slider 50 is above the lock arm 27 and the upper walls 30, the bottom section 52 of the slider 50 is below the bottom wall 33, and the side sections 53, 54 are inwardly of the corresponding side walls 32. The slider 50 is shorter than the terminal-accommodating portion 21 along the connecting direction CD. Thus, the slider 50 can move forward and back on the terminal-accommodating portion 21 along the connecting direction CD.

Two walls project down from the lower surface of the top section 51 of the slider 50, and a holding arm 55 cantilevers back from the rear end of each wall, as shown in FIGS. 1 and 5. Each holding arm 55 is resiliently deformable up and down in a direction intersecting the connecting direction CD, and a hook 56 projects from the lower surface of the leading end thereof. The holding arms 55 move along sides of the lock arm 27 as the slider 50 is assembled into the female housing 20 from the front. The hooks 56 engage holding projections 38 on the upper surface of the terminal-accommodating portion 21 when the slider 50 reaches a front-limit position on the female housing 20, as shown in FIG. 11(A). At this stage, the top section 51 of the slider 50 is retracted back from the deformation space S for the lock arm 27, and is in a deformation permitting position that permits resilient deformation of the lock arm 27. The slider 50 can be moved forward from the deformation permitting position to a deformation preventing position where a deformation preventing portion 51*a* at the front of the top section 51 is in the deformation space S to prevent deformation of the lock arm 27 (see FIG. 14(A)). A slanted guide surface 56*a* slopes up at the front of each hook 56 and engages the corresponding holding projection 38. The guide surfaces 56*a* cause the holding arms 55 to deform when a force of a specified intensity or higher acts on the slider 50 to move the slider 50 forward. Thus, the hooks 56 disengage from the holding projections 38

Two slits are formed at the rear end of the upper section 51 to provide a cantilevered pushable piece 57 substantially at a widthwise middle position, as shown in FIGS. 3 and 5. A projection 57*a* projects up at the rear end of the pushable piece 57 and can be pressed from above to deform the pushable piece 57 down. The pushable piece 57 is above the lock arm 27 and rearward of the support 26 when the slider 50 is at the deformation permitting position. Thus, the lock arm 27 can be deformed resiliently by pressing and resiliently deforming the pushable piece 57 (see FIG. 15(A)).

Two supporting plates 58 project up from the bottom section 52 of the slider 50 at positions near the sides 53, 54, as shown in FIGS. 1 and 5. The supporting plates 58 abut front surfaces of the stopper walls 34 to support the slider 50 and to prevent backward movement from the deformation permitting position. An operable portion 59 projects down at the rear of the bottom section 52 over substantially the entire width and enables the slider 50 to be pulled back.

Substantially circular spring insertion recesses 60 are formed in the rear surfaces of the upper parts of the opposite side sections 53, 54 of the slider 50, as shown in FIGS. 4 and 6. The spring insertion recesses 60 closely receive the upper ends 40*a* of the compression coil springs 40, and terminate at receiving surfaces 60*a* that engage the extreme ends of the compression coil springs 40. Accommodation recesses 61 are formed in the rear surfaces of the bottom parts of the opposite side sections 53, 54 for accommodating the spring press 41 and the lower ends 40*b* of the compression coil springs 40. The spring press 41 engages the front surface of the accommodation recess 61 for support at its front-limit position. A spring support 62 projects back along part of each side section 53, 54 between the recesses 60, 61 and has a curved rear surface 62*a*. The compression coil springs 40 are held closely between the curved surfaces 62*a* of the spring supports 62 and the curved surfaces 31*a* of the push-operable portion 31 (see FIG. 11(B)) when the slider 50 is at the deformation permitting position.

Insertion holes 63 are formed at parts of the side sections 53, 54 outside the spring supports 62 and open forward and back, as shown in FIGS. 4 and 5. The insertion holes 63 are dimensioned to receive the sidewalls 32. Insertion grooves 64 are formed at the outer peripheries of the insertion holes 63 and receive front-stops 39 that project from the outer side surfaces of the side sections 32. A front-stop wall 65 is at the rear end of each insertion groove 64 and engages the corresponding front-stop 39 when the slider 50 reaches the deformation preventing position to stop the slider 50 at its front-limit position (see FIG. 14(A)). The side section 54 at the right side of FIG. 1 has a retainer insertion hole for receiving the retainer 24 (see FIG. 8).

The female connector is assembled by orienting the spring press 41 and the female housing 20, as shown in FIGS. 5 and 6, and then inserting the spring press 41 from behind to the initial position in the spring press accommodating space 37. The compression coil springs 40 then are curved into a substantially U-shape and accommodated in the spring accommodating spaces 36. More particularly, the lower ends 40*b* of the compression coil springs 40 are fit on the spring holding portions 42 of the spring press 41. The slider 50 then is assembled to the female housing 20 from the front and is moved to the deformation permitting position. In this assembling process, the holding arms 55 move to the sides of the lock arm 27 and the hooks 56 move onto the holding projections 38 to deform the holding arms 55 resiliently up. The hooks 56 move over the holding projections 38 when the slider 50 reaches the deformation permitting position and the holding arms 55 return. Thus, the front surfaces of the hooks 56 engage the rear surfaces of the holding projections 38, as shown in FIG. 11, to prevent the slider 50 from making any forward movement from the deformation permitting position before the connecting operation is started. At this time, the upper ends 40*a* of the compression coil springs 40 are inserted into the spring accommodation recesses 60 and the front end surfaces thereof contact the receiving portions 60*a*. Further, the female terminal fittings, the retainer 24, the seal ring 25, etc. are mounted into the female housing 20.

Figure 12A:
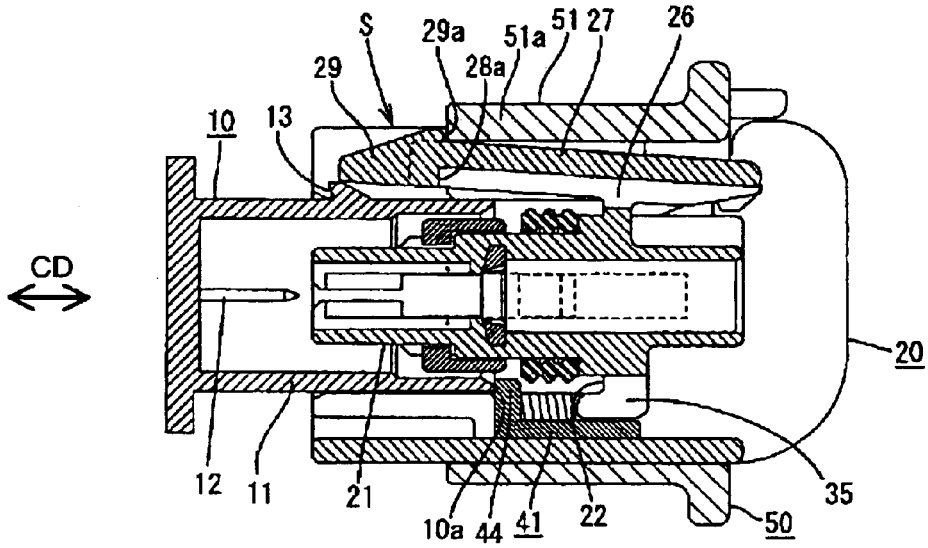
FIGS. 12(A) and 12(B) are sections similar to FIGS. 11(A) and 11(B) showing a front end of a receptacle contacting the spring press during the connection of the two housings.
Figure 12B:
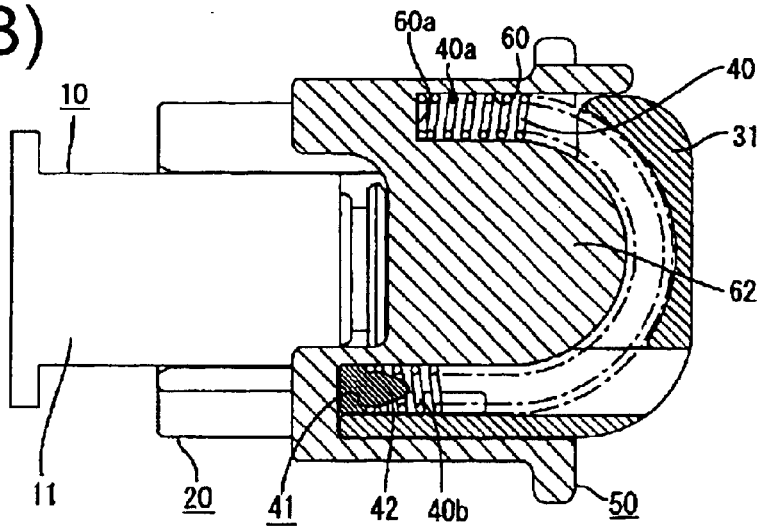

An operator can connect the male and female housings 10, 20 along the connecting direction CD by aligning the fitting groove 22 of the female housing 20 with the receptacle 11 of the male housing 10 and pushing the female housing 20, the slider 50 or both toward the male housing 10. The projection 29 of the lock arm 27 moves onto the lock 13 and deforms the lock arm 27 resiliently as the receptacle 11 of the male housing 10 fits into the fitting groove 22 of the female housing 20. At this time, the front end of the lock arm 27 and the projection 29 enter the deformation space S above and the forward-movement preventing portion 29*a* engages the front end surface of the upper section 51 of the slider 50, as shown in FIG. 12, to prevent the slider 50 from moving forward from the deformation permitting position. As the connecting operation proceeds, the front end surface 10*a* of the receptacle 11 contacts and pushes back the pushable sections 44 of the spring press 41, as shown in FIG. 12. As a result, the spring press 41 is moved back from the initial position to the pushed position. At this time, the receiving portions 60*a* of the slider 50 prevent forward movement of the upper ends 40*a* of the compression coil springs 40. Thus, the compression coil springs 40 are compressed resiliently between the receiving portions 60*a* and the backward-moving spring press 41 and gradually accumulate biasing forces that could separate the two housings 10, 20 (see FIG. 13(B)).

The connecting operation could be interrupted halfway. However, the biasing forces accumulated thus far in the resiliently compressed coil springs 40 are released and the pushable sections 44 of the spring press 41 push the front end surface 10*a* of the receptacle 11 back to separate the housings 10, 20. This prevents the two housings 10, 20 from being left partly connected.

Figure 13A:
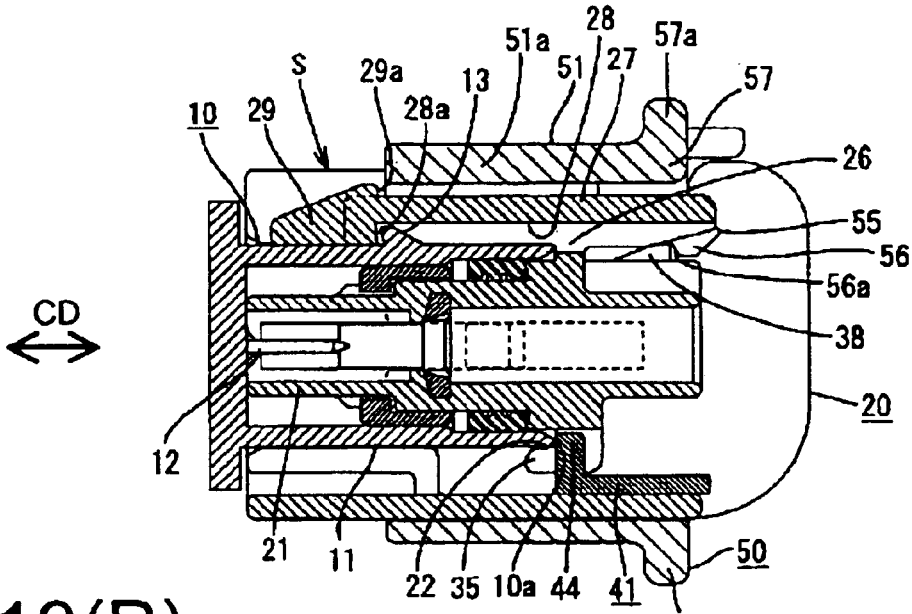
FIG. 13(A) is a section similar to FIG. 11(A) showing the housings properly connected and a forward-movement preventing portion disengaged from the slider.
Figure 13B:
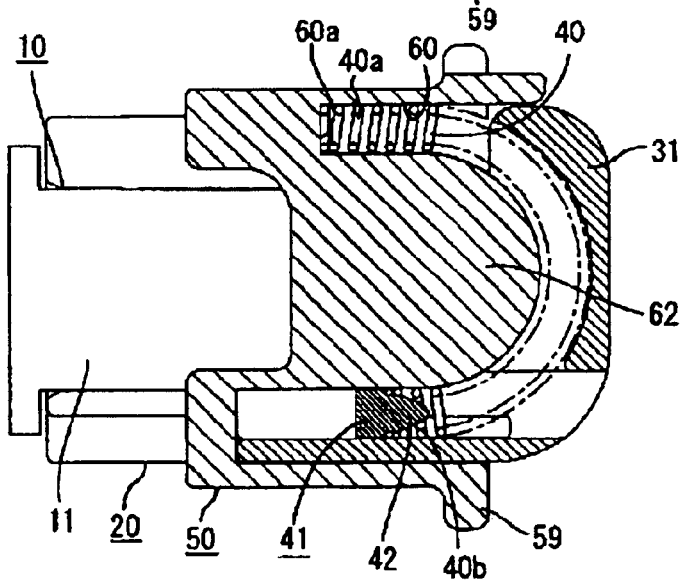
FIG. 13(B) is a section similar to FIG. 11(B) showing the housings properly connected and compression coil springs resiliently compressed.

The lock 13 enters the groove 28 of the lock arm 27 when the two housings 10, 20 are connected to proper depth. Thus, the lock arm 27 resiliently returns and the front-end surface 28*a* of the groove 28 engages the rear surface of the lock 13, as shown in FIG. 13. The forward-movement preventing portion 29*a* disengages from the upper section 51 of the slider 50 as the lock arm 27 returns. On the other hand, the lower ends 40*b* of the compression coil springs 40 are received by the spring press 41, and the spring press 41 is held at the pushed position by the front end surface 10*a* of the receptacle 11 engaged with the engaging portion 35. Accordingly, the biasing forces accumulated in the compression coil springs 40 are released and the receiving portions 60*a* are pushed forward by the upper ends 40*a* of the compression coil springs 40. Thus, a force acts on the slider 50 to move the slider 50 forward toward the deformation preventing position. Upon receiving such a force, the holding arms 55 are guided by the guiding surfaces 56*a* through a resilient deformation and the hooks 56 disengage from the holding projection 38. Thus, the slider 50 is freed and the biasing forces of the compression coil springs 40 moves the slider 50 forward from the deformation permitting position to the deformation preventing position.

Figure 14A:
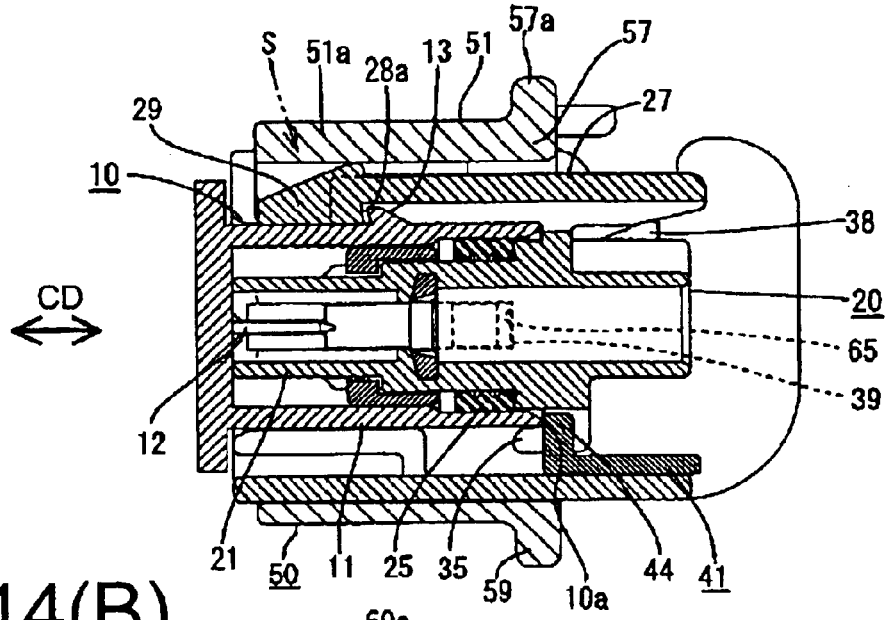
FIGS. 14(A) and 14(B) are sections similar to FIGS. 11(A) and 11(B) showing the slider moved forward to a deformation preventing position.
Figure 14B:
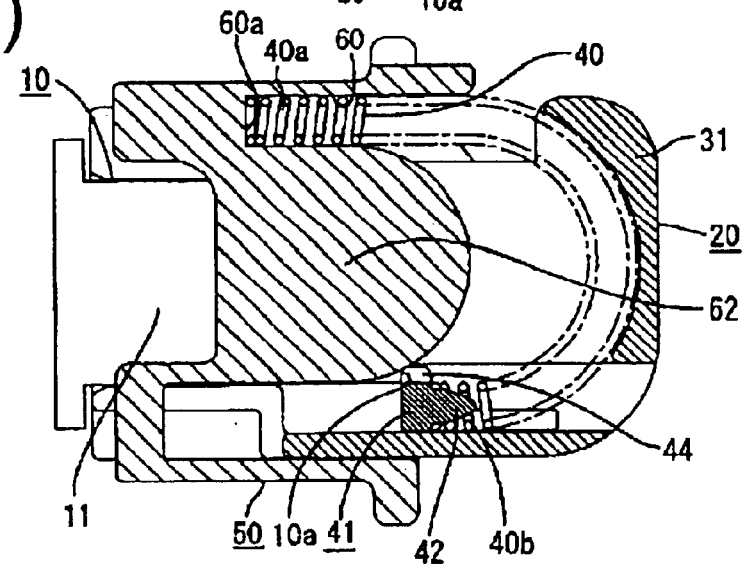

The deformation preventing portion 51*a* enters the deformation space S when the slider 50 reaches the deformation preventing position and contacts the projection 29 from above, as shown in FIG. 14. Thus, the lock arm 27 is engaged with the lock 13 and is prevented from undergoing a resilient deformation. In this way, the two housings 10, 20 are held properly connected with each other. A moving stroke of the slider 50 is set to be substantially the same as a maximum degree of compression of the compression coil springs 40. Thus, the compression coil springs 40 are returned substantially to the state that existed before the connecting operation between the receiving portions 60*a* and the spring press 41 held at the pushed position. Further, the front-stop walls 65 contact the front-stop projections 39 to prevent the slider 50 from moving forward toward the deformation permitting position from the deformation preventing position. In the properly connected state, the seal ring 25 closely contacts the inner peripheral surface of the receptacle 11 and the outer peripheral surface of the terminal-accommodating portion 21 to provide a watertight fit between the housings 10, 20.

Figure 15A:
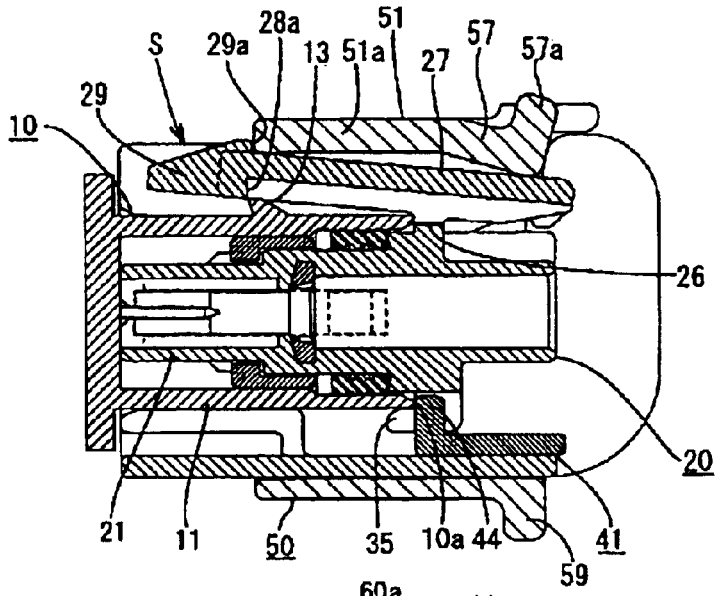
FIG. 15(A) is a section similar to FIG. 11(A) showing a pushable piece deforming the lock arm during separation of the two housings.
Figure 15B:
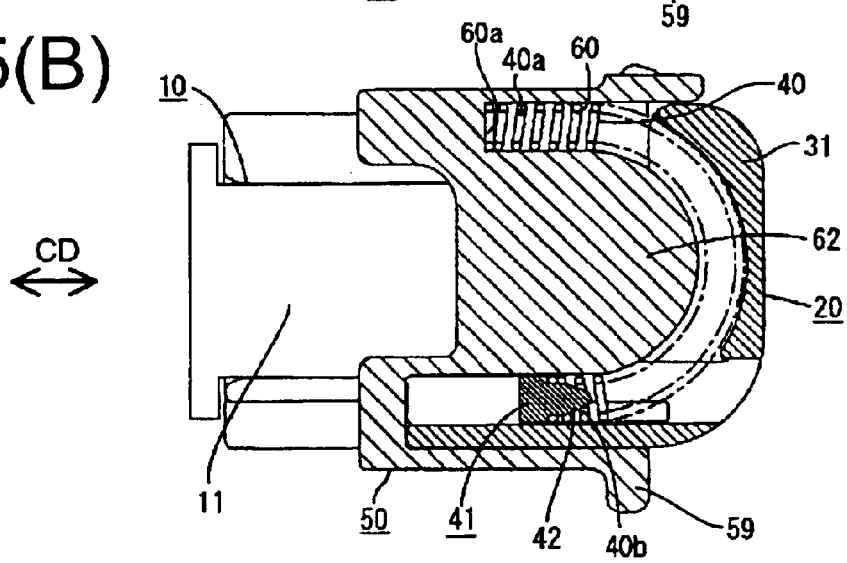
FIG. 15(B) is a section similar to FIG. 11(B) showing the slider at a deformation permitting position and the compression coil springs resiliently compressed.

The housings 10, 20 may require separation for maintenance or other reason. In such a case, the operable portions 59 and/or the projection 57*a* of the pushable piece 57 are gripped to pull the slider 50 back. The slider 50 is moved back from the deformation preventing position to the deformation permitting position and the coil springs 40 are compressed. The projection 57*a* of the pushable piece 57 then is pushed down to deform the pushable piece 57, as shown in FIG. 15. As a result, the lower surface of the pushable piece 57 pushes the upper surface of the rear part of the lock arm 27. The lock arm 27 deforms and the front-end surface 28*a* of the groove 28 disengages from the lock 13. The slider 50 then can be pulled further back to separate the female housing 20 from the male housing 10. The separating operation could be interrupted halfway. However, the biasing forces of the resiliently compressed coil springs 40 will be released and the pushable sections 44 of the spring press 41 will push the front end surface 10*a* of the receptacle 11 back to separate the housings 10, 20. As a result, the housings 10, 20 will not be left partly connected during the separating operation. An operation of moving the slider 50 back to the deformation permitting position and an operation of separating the housings 10, 20 is performed at once by pulling the slider 50. Further, the lock arm 27 is deformed resiliently by operating the pushable piece 57 following the operation of pulling the slider 50.

As described above, the compression coil springs 40 are curved so that opposite ends of the coil springs 40 face forward. Additionally, the biasing forces of the coil springs 40 are released and move the slider 50 forward when the housings 10, 20 are connected properly. Thus, the slider 50 and the female housing 20 are moved in the same direction for separation and operational efficiency during separation is improved. Further, movement of the lock arm 27 is linked with the connecting operation and controls the forward movement of the slider 50. Thus, the slider 50 is moved at a suitable timing, and the reliability of the partial connection preventing function is improved. Furthermore, the pushable sections 44 of the spring press 41 are pushed by the front-end surface 10*a* of the receptacle 11 of the male housing 10. Thus, the construction of the male housing 10 is simpler than a male housing that has a separate pushing portion.

The holding arms 55 engage the holding projections 38 to hold the slider 50 at the deformation permitting position. Thus, the connecting operation is performed with the slider at the deformation permitting position, and connection operability is better. Further, the guiding surfaces 56*a* on the hooks 56 engage the holding projections 38 to achieve a semi-locking construction. Therefore, the biasing forces of the compression coil springs 40 automatically disengage the holding arms 55 from the holding projections 38. Accordingly, operability is better than a case where the holding arms must be deformed separately.

The lock arm 27 can be pushed and deformed by pushing the pushable piece 57 of the slider 50 when the housings 10, 20 are being separated. Thus, operability is better than a case where the lock arm must be pushed after the slider is moved backward.

A second embodiment of the invention is described with reference to FIGS. 16 to 20. The second embodiment differs from the first embodiment in the construction of the upper section 51 of the slider 50 and the rear end of the lock arm 27. Elements of the second embodiment that are similar to the first embodiment are identified by the same numbers.

Figure 16:
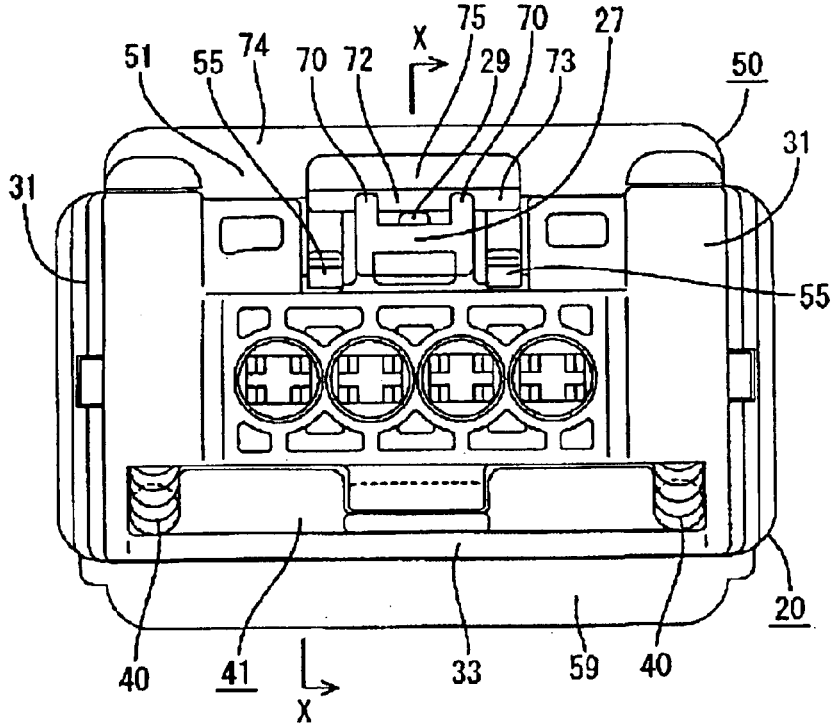
FIG. 16 is a rear view showing a slider assembled into a female housing according to a second embodiment of the present invention.
Figure 18:
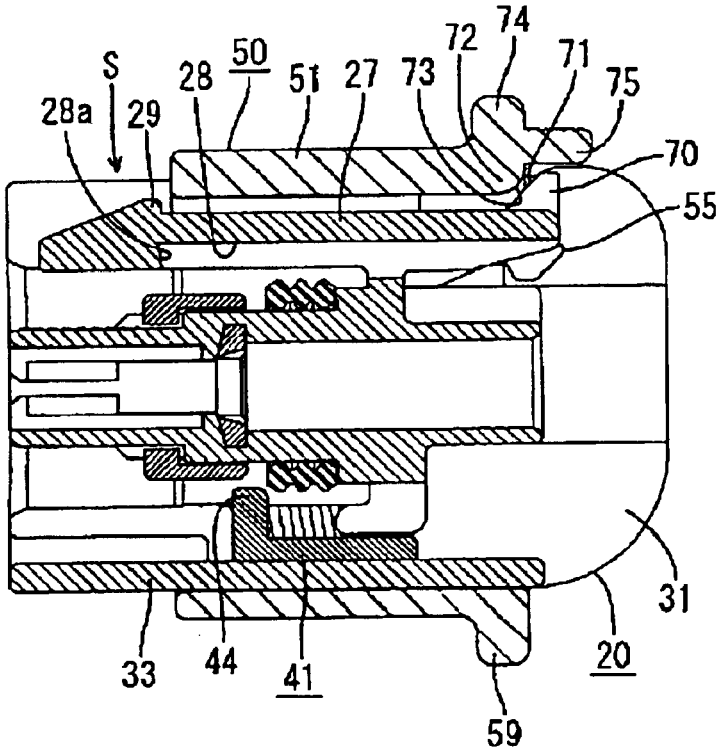
FIG. 18 is a section along 18—18 of FIG. 16.

Two disengagement guides 70 project up toward the upper section 51 of the slider 50 from the rear end of the upper surface of the lock arm 27, as shown in FIGS. 16 and 18. The two disengagement guides 70 are at opposite lateral sides of the lock arm 27 and are spaced from each other along the widthwise direction. Each disengagement guide 70 has a slanted surface 71 sloped up and back, and the upper section 51 of the slider 50 is engageable with the slanted surfaces 71 from front. Further, the upper ends of the disengagement guides 70 are higher than the projection 29.

A disengagement-pushing portion 72 bulges down toward the lock arm 27 from the widthwise middle of the upper section 51 of the slider 50 more than the opposite sides of the upper section 51, as shown in FIG. 16. The disengagement-pushing portion 72 can push the disengagement guides 70. A moderately curved surface 73 extends along the disengagement portion 72 at the rear bottom end of the disengagement-pushing portion 72 for contacting the disengagement guides 70. Thus, the disengagement guides 70 can be pushed smoothly. The bottom end of the disengagement-pushing portion 72 is lower than the upper ends of the disengagement guides 70 and slightly higher than the upper ends of the projection 29 of the lock arm 27.

In this embodiment, an initial assembled position and a disengaging position are set as the deformation permitting position of the slider 50. The slider 50 is movable forward and back along the connecting direction CD between these positions. The initial assembled position is the same as the deformation permitting position of the first embodiment and is a position where the slider 50 is assembled with the female housing 20 before the housings 10, 20 are connected, as shown in FIG. 18. At this position, the disengagement-pushing portion 72 is displaced before the disengagement guides 70 so as not to interfere with the disengagement guides 70. The slider 50 is movable further back from the initial assembled position to the disengaging position (see FIG. 20) where the disengagement-pushing portion 72 engages the disengagement guides 70. Although unillustrated, the slider 50 is prevented from moving back by engaging the opposite sides 33*a* of the bottom wall 33 and the stopper walls 34 upon reaching the disengaging position. Additionally, a space between the curved surfaces 31*a*, 62*a* of the push-operable portions 31 and the spring supports 62 is wider than in the first embodiment to let the compression coil springs 40 escape when the slider 50 is moved to the disengaging position.

Figure 17:
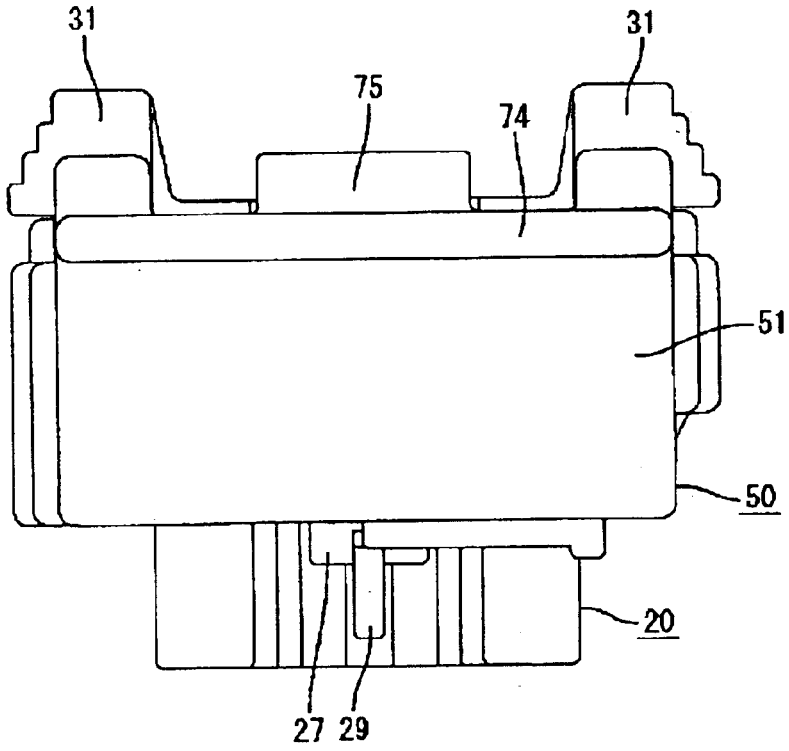
FIG. 17 is a plan view with the slider assembled into the female housing.

An upper operable portion 74 projects at the rear end of the upper section 51 of the slider 50, as shown in FIGS. 16 to 18. The upper operable portion 74 is a narrow rib that extends over substantially the entire width of the slider 50. The slider 50 can be pushed forward and pulled back by operating the upper and/or lower operable portions 74, 59. Further, a substantially flat planar protecting portion 75 extends back at the rear end of the upper section 51 of the slider 50 and the upper operable portion 74. The protecting portion 75 is above the disengagement guides 70 so as not to interfere with the disengagement guides 70. The protecting portion 75 has a length and a width to substantially cover the rear ends of the lock arm 27 and the holding arms 55 from above when the slider 50 is at the initial assembled position to prevent the lock arm 27 and the holding arms 55 from being operated inadvertently by external matter.

Figure 19:
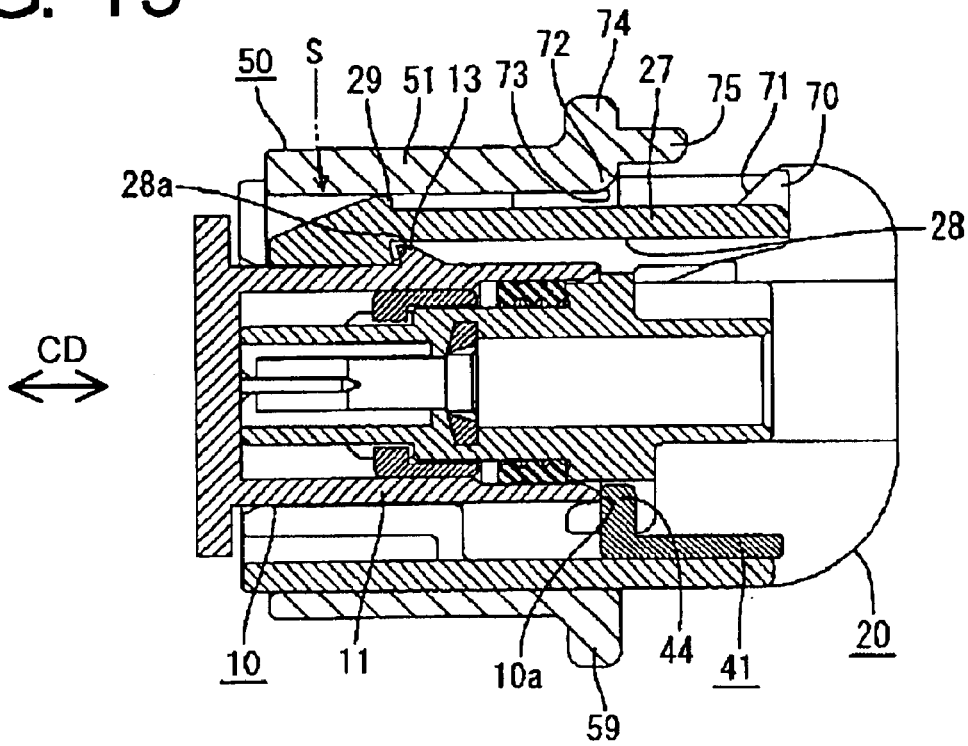
FIG. 19 is a section along 19—19 of FIG. 16 with the female housing connected with a male housing and the slider at a deformation preventing position.
Figure 20:
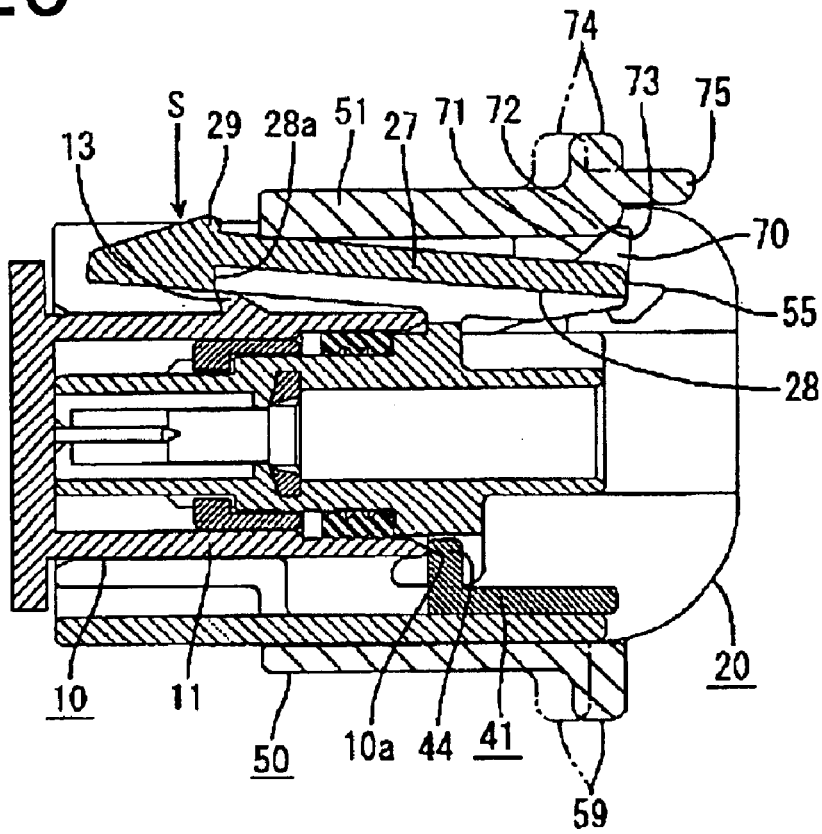
FIG. 20 is a section along 19—19 of FIG. 16 showing the slider moved back to a disengaging position and a lock arm is resiliently deformed.
Figure 21A:
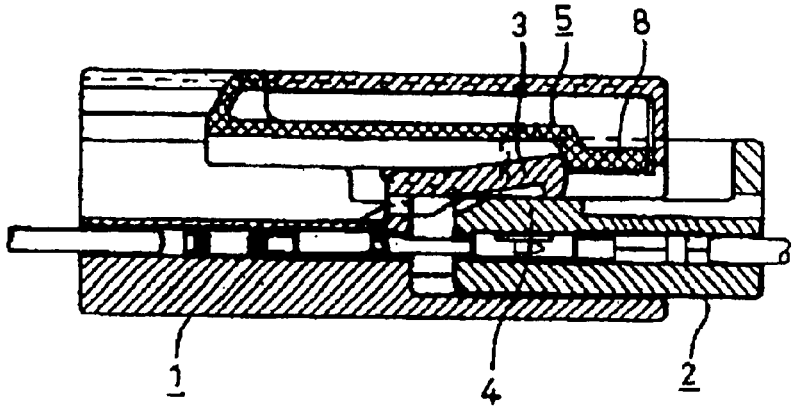
FIG. 21(A) PRIOR ART
FIGS. 21(A) and 21(B) are a section along a lock arm and a section along a spring showing a partly connected state of a prior art connector.
Figure 21B:
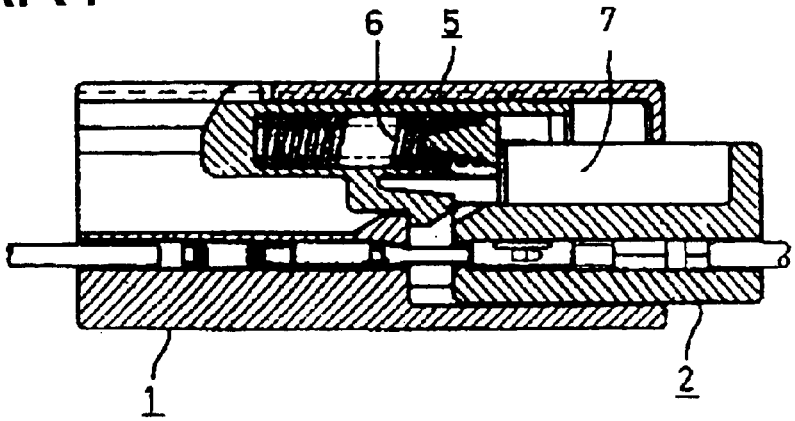
FIG. 21(B) PRIOR ART
Figure 22A:
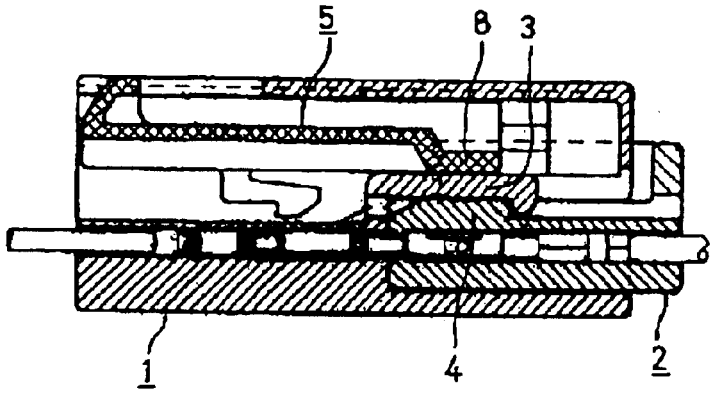
FIG. 22(A) PRIOR ART
FIGS. 22(A) and 22(B) are a section along the lock arm and a section along the spring showing a properly connected state of the prior art connector.
Figure 22B:
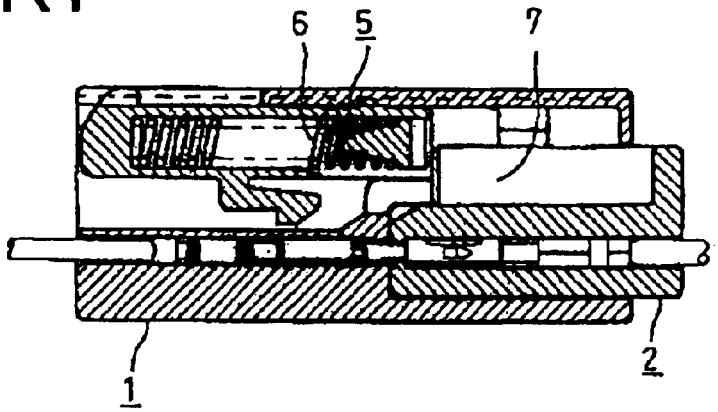
FIG. 22(B) PRIOR ART

The properly connected housings 10, 20 can be separated by gripping the upper and/or lower operable portions 74, 59 as shown in FIG. 19, and pulling the slider 50 back from the deformation preventing position toward the deformation permitting position. The slider 50 is retracted from the deformation space S and pulled further back from the initial assembled position (shown by phantom line in FIG. 20). As a result, the curved surface 73 of the disengagement pushing portion 72 contacts the slanted surfaces 71 of the disengagement guides 70. The disengagement pushing portion 72 pushes the disengagement guides 70 as the slider 50 is pushed further back toward the deformation permitting position. This pushing force is translated by the slanted surface 71 to push the rear end of the lock arm 27 and to disengage the front end surface 28*a* of the groove 28 from the rear end of the lock 13, as shown in FIG. 20. The slider 50 is pulled further back toward the deformation permitting position in this state, and the female housing 20 is moved back and pulled apart from the male housing 10. This separating operation could be interrupted halfway. In this situation, the biasing forces of the compressed coil springs 40 are released and the pushable sections 44 of the spring press 41 push the front end surface 10*a* of the receptacle 11 back to forcibly separate the housings 10, 20. As a result, the housings 10, 20 are not left partly connected during the separating operation. In this way, an operation of moving the slider 50 back toward the disengaging position as the deformation permitting position and an operation of separating the two housings 10, 20 can be performed at once by pulling the slider 50 backward.

As described above, the slider 50 is moved from the deformation preventing position toward the deformation permitting position to separate the housings 10, 20. Thus, the disengagement pushing portion 72 of the slider 50 pushes the disengagement guides 70 to deform the lock arm 27 and disengage the lock arm 27 from the lock 13. The lock arm 27 is deformed by moving the slider 50 back. Thus, separation operability is better as compared to a case where an operation of resiliently deforming the lock arm needs to be performed separately from the operation of the slider.

The invention is not limited to the above described embodiment. For example, the following embodiments also are embraced by the invention as defined in the claims. Beside the following embodiments, various changes can be made without departing from the scope of the invention as defined in the claims.

The connector includes the spring press in the foregoing embodiment. However, ends of the springs may be pushed directly by a male housing.

The guides are on the holding arms in the foregoing embodiment. However, they may be on the holding projections or may be provided on both.

The pushable piece is pushed to deform the lock arm for separating the housings in the foregoing embodiment. However, a guide surface may be provided on either the lock arm or the lock projection. Additionally, the lock arm may be deformed automatically and resiliently to effect unlocking when an operation force of a specified intensity or higher is given by the guiding surface to separate the two housings. Then, operability can be even more improved.

Although the slider, the coil springs and the spring press are assembled into the female housing and the spring press is pushed by the male housing in the foregoing embodiment, connectors in which male and female housings have reverse constructions also are embraced by the invention.

The compression coil springs are shown as biasing means in the foregoing embodiment. However, leaf springs or the like may be used as such.

The connector has a watertight function (seal ring) in the foregoing embodiment, the invention also is applicable to non-watertight connectors.

What is claimed is:

1. A connector, comprising:

a housing connectable with a mating housing;

a lock arm having a support on the housing and having front and rear ends extending in opposite directions from the support, the lock arm resiliently deforming while the front end of the look moves onto a lock of the mating housing in a process of connecting the housings, the lock arm returning toward and undeformed state and engaging the lock when the housings are connected properly;

a slider assembled to the housing and movable substantially along a connecting direction of the housings between a deformation preventing position where the slider enters a deformation space for the lock arm to prevent the deformation of the lock arm and a deformation permitting position where the slider is retracted from the deformation space to permit resilient deformation of the lock arm, the slider having a pushable portion align with the rear end of the lock arm when the slider is at the deformation permitting position, the pushable portion of the slider being deflectable toward the rear end of the lock arm for deflecting the rear end of the lock arm inwardly toward the housing so that the front end of the lock arm moves away from the lock on the mating housing; and at least one biasing member curved between the slider and the mating housing; wherein:

the lock arm being configured to prevent movement of the slider to the deformation preventing position when the lock arm is deformed by the lock during connection of the housings and the biasing member being compressed between the mating housing and the slider during connection of the housings while accumulating a biasing force to separate the two housings; and the lock arm returns to engage the lock when the housings are connected properly so that the biasing member moves the slider to the deformation preventing position.

2. The connector of claim 1, wherein the slider is moved back from the deformation preventing position to the deformation permitting position end the connector housing is pulled back from the mating housing while the lock arm is deformed to separate the housings.

3. The connector of claim 1, wherein the biasing member is curved so that the opposite ends thereof face the mating housing and are mounted so that one end thereof is received by a receiving portion of the slider and the other end is pushed by a pushing portion of the mating housing, and wherein the biasing member is compressed between the pushing portion and the holding portion.

4. The connector of claim 1, wherein the slider has a holding arm to prevent the slider from moving forward from the deformation permitting position by engaging a holding portion of the housing.

5. The connector of claim 4, wherein one of the holding arm and the holding portion has a guiding surface for deforming the holding arm away from the holding portion in response to a force of a specified intensity on the slider.

6. The connector according of claim 1, wherein the lock arm comprises a disengagement guide which is pushed by the slider moving toward the deformation permitting position upon separating the housings, thereby guiding the lock arm through a resilient deformation away from the lock.

7. The connector of claim 1, wherein the slider comprises a protector formed to cover at least parts of the lock arm and the holding arm, and to prevent the lock arm and the holding arm from being operated inadvertently.

8. The connector of claim 1, wherein a seal ring is mountable on the housing to provide water tightness between the two housings.

9. The connector of claim 1, wherein a moving stroke of the slider is substantially the same as a maximum degree of compression of the biasing member.

10. A connector, comprising:

a housing having opposite front and rear ends, a resiliently deformable lock arm on the housing and having a locking portion adjacent the front end of the housing and an actuating portion substantially adjacent the rear end of the housing;

a slider assembled to the housing and movable along a moving direction relative to the housing between a front position where the slider substantially covers the locking portion to prevent deformation of the lock arm and a rear position where the slider is spaced from the locking portion to permit deformation of the lock arm, the slider having a pushable portion aligned with the actuating portion of the lock arm when the slider is in the rear position, the pushable portion the slider being deflectable toward the housing and at an angle to the moving direction of the slider into engagement with the actuating portion of the lock arm for generating deformation of the lock arm; and at least one biasing member between the slider and the housing for urging the slider to the front position.

11. A connector, comprising:

a housing having opposite front and rear ends, a resiliently deformable lock arm on the housing and having a locking portion adjacent the front end of the housing and an actuating portion substantially adjacent the rear end of the housing;

a slider assembled to the housing and movable between a front position where the slider substantially covers the locking portion to prevent deformation of the lock arm and a rear position where the slider is spaced from the locking portion to permit deformation of the lock arm, the slider having a pushable portion aligned with the actuating portion of the lock arm when the slider is in the rear position for generating deformation of the lock arm; and at least one biasing member between the slider and the housing for urging the slider to the front position, wherein the biasing member is curved into a U-shape, and has opposed ends facing the front end of the housing.

12. The connector of claim 11, wherein the slider has a holding arm to prevent the slider from moving forward from the rear position by engaging a holding portion of the housing.

13. The connector of claim 12, wherein one of the holding arm and the holding portion has a guiding surface for deforming the holding arm away from the holding portion in response to a force of a specified intensity on the slider.

14. A connector, comprising:

a first housing having a lock;

a second housing connectable with the first housing along a connecting direction, the second housing having a resiliently deformable lock arm joined to remaining portions of the second housing by a support and having front end projecting fowardly from the support and configured for engaging the lock and being deformed by the lock during connection of the housings, the lock arm further having an actuating portion spaced rearwardly from the support, the lock arm restoring toward an undeformed state and locking with the lock when the housings are connected properly;

a slider assembled to the second housing and movable between a deformation preventing position where the slider prevents deformation of the lock arm and a deformation permitting position where the slider permits deformation of the lock arm, the slider having a pushable portion movable at an angle to the connecting direction for pushing the actuating portion of the lock arm to forceably deform the lock arm when the slider is at the deformation permitting position; and at least one biasing member between the slider and the second housing for urging the slider to the deformation preventing position.

15. The connector of claim 14, wherein the biasing member is curved into a U-shape, and has opposed ends facing the first housing.

16. The connector of claim 15, wherein the slider has a holding arm to prevent the slider from moving forward from the deformation preventing position by engaging a holding portion of the housing.

17. The connector of claim 16, wherein one of the holding arm and the holding portion has a guiding surface for deforming the holding arm away from the holding portion in response to a force of a specified intensity on the slider.

* * * * *